United States Patent [19]

Sanderson et al.

[11] Patent Number: 5,024,138

[45] Date of Patent: Jun. 18, 1991

[54] AIRCRAFT ARMAMENT APPARATUS

[76] Inventors: Paul H. Sanderson, 2019 Cripple Creek, Lewisville, Tex. 75067; Richard C. Serkland, 1010 Meadowlake Dr., McKinney, Tex. 75069

[21] Appl. No.: 532,172

[22] Filed: Jun. 4, 1990

Related U.S. Application Data

[60] Continuation of Ser. No. 297,970, Jan. 17, 1989, abandoned, which is a division of Ser. No. 144,873, Jan. 13, 1988, Pat. No. 4,893,545.

[51] Int. Cl.[5] ..... F41A 23/00

[52] U.S. Cl. ..... 89/37.22; 89/37.19

[58] Field of Search ..... 89/37.16, 37.17, 37.19, 89/37.21, 37.22, 1.815–1.817, 41.21; 244/14

[56] References Cited

U.S. PATENT DOCUMENTS

| | | | |
|---|---|---|---|
| 882,988 | 3/1908 | Aloyos et al. | 89/37.04 |
| 1,757,244 | 5/1930 | Green | 89/37.19 |
| 2,378,545 | 6/1945 | Fraser et al. | 89/37.04 |
| 2,380,773 | 7/1945 | McMullen | 89/37.5 |
| 2,398,871 | 4/1946 | Turnbull et al. | 89/1.815 |
| 2,401,860 | 6/1946 | Corte | 89/1.4 |
| 2,433,637 | 12/1947 | Trotter | 89/42 |
| 2,709,947 | 6/1955 | Woods | 89/1.815 |
| 2,731,829 | 1/1956 | Wigington et al. | 73/167 |
| 2,731,885 | 1/1956 | Nolan | 89/1.815 |
| 2,958,260 | 11/1960 | Anderson | 89/1.815 |
| 3,438,304 | 4/1969 | Sautier et al. | 89/37.5 |
| 3,608,426 | 9/1971 | Jackson, Jr. | 89/37.19 |
| 3,766,829 | 10/1973 | Cords | 89/1.817 |
| 3,805,608 | 4/1974 | Schmidt et al. | 73/167 |
| 4,090,340 | 5/1978 | Becker | 52/309.11 |
| 4,333,385 | 6/1982 | Culver | 89/37.04 |
| 4,429,611 | 2/1984 | Oldham et al. | 89/1.816 |
| 4,587,881 | 5/1986 | Clayson et al. | 89/37.16 |
| 4,762,049 | 8/1988 | Hughes | 89/37.16 |

FOREIGN PATENT DOCUMENTS

| | | | |
|---|---|---|---|
| 1095167 | 6/1957 | Fed. Rep. of Germany | 89/37.5 |
| 849186 | 8/1939 | France | 89/37.04 |
| 81822 | 5/1953 | Norway | 89/37.04 |
| 1387669 | 3/1975 | United Kingdom | 89/1.816 |

OTHER PUBLICATIONS

General Electric, XM-3520-mm Armament Subsystem, (9/69) (024-516A)

General Electric, Coin Aircraft Armament, (3/69) (024-516).

Douglas Aircraft Company Inc., DGP-1 Twin. 50 cal. Gun Package (3/6/44), pp. 1-38.

Hughes Gun Systems, XM-8 Anti-Personnel Suppressive Fire Weapon System, (9/69), pages unnumbered.

Hughes Gun Systems, XM-8 Anti-Personnel Suppressive Fire Weapon System, 9/69, (entire document).

Douglas Aircraft Company, Douglas Gun Package, 3/6/44, (entire document).

*Primary Examiner*—Charles T. Jordan

*Assistant Examiner*—Stephen Johnson

*Attorney, Agent, or Firm*—Johnson & Gibbs

[57] ABSTRACT

An aircraft armament mounting system includes an elongated support plank member which is insertable transversely through the aircraft cabin area so that a central portion of the plank is disposed within the cabin area and its opposite end portions project outwardly from the aircraft. This central portion is anchored to the aircraft, and outer tip portions of the plank are pivotable between extended and inwardly folded positions. A pair of rocket launchers are mounted on downwardly projecting support structures secured to the outer ends of the plank tip portions, the support structure having integral adjustment mechanisms which permit vertical and horizontal adjustment of the rocket launcher firing axes. Supported on the underside of the plank end portions, inwardly of the foldable tip sections, are a pair of machine gun pods supported on specially designed shock absorbing gun mounts which carry a pair of machine guns provided with electrically driven charging assemblies. The charging assemblies are operative to drive the bolt pins of the guns to their safe posiitons and then allow the pins to be driven to their armed positions by their associated return springs. External ammunition belt magazines are disposed within the cabin area, the ammunition belts from such magazines being routed to their associated guns through openings formed in the outer end portions of the support plank member. The gun pods may alternatively be mounted on wing pylons of a fixed wing aircraft and supplied from external ammunition magazines also supported on wing pylons spaced outwardly from the gun pods.

18 Claims, 9 Drawing Sheets

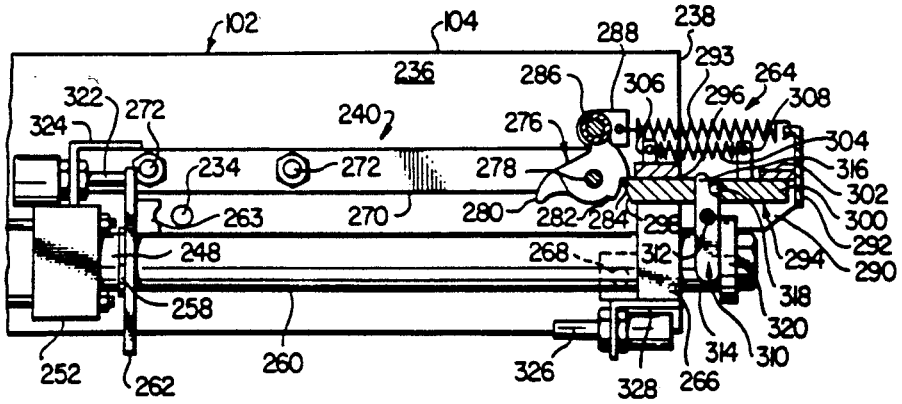
FIG. 17
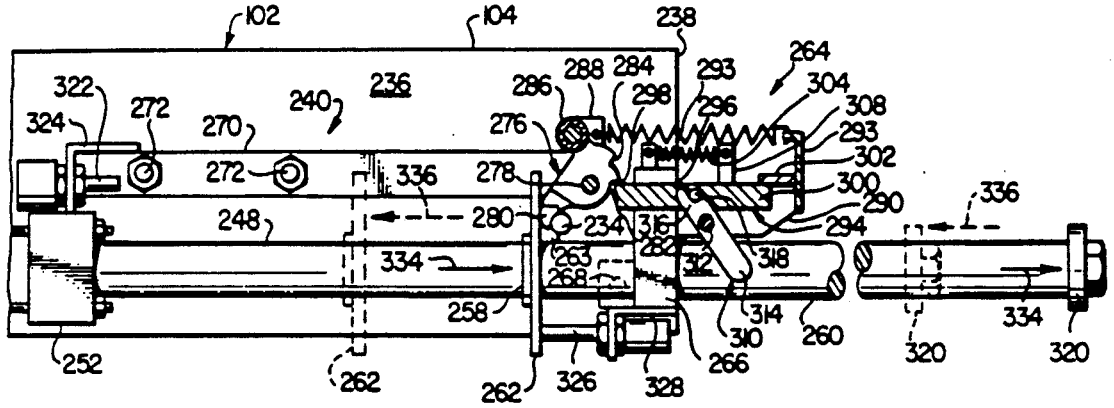
FIG. 18
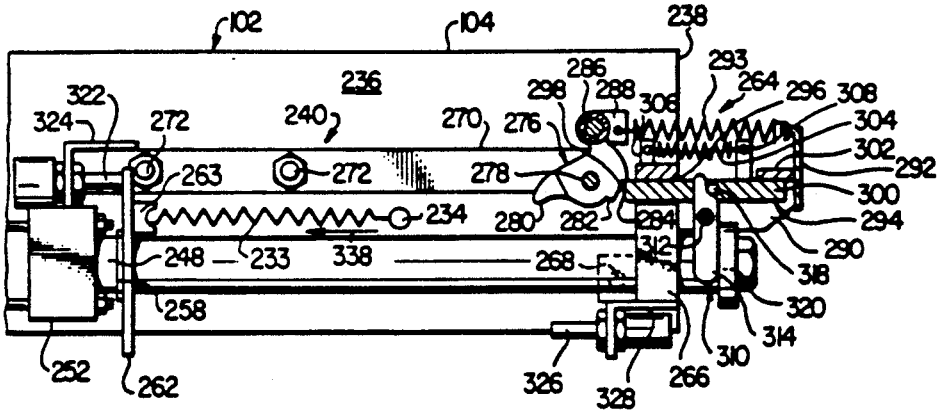
FIG. 19
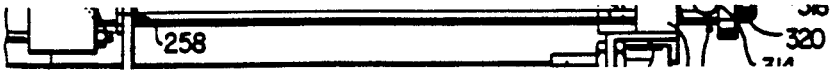

AIRCRAFT ARMAMENT APPARATUS

This application is a continuation of application Ser. No. 297,970 now abandoned, filed Jan. 17, 1989 which is a division of application Ser. No. 144,873, filed Jan. 13, 1988, now U.S. Pat. No. 4,893,545.

BACKGROUND OF THE INVENTION

The present invention relates generally to armament apparatus for aircraft, and more particularly provides substantial improvements in such apparatus, including a specially designed support structure for mounting machine gun pods and other weaponry on an aircraft, and a machine gun pod featuring a unique shock absorbing gun mount and an electrically driven gun charging assembly mounted on the gun and providing for substantially improved control of its bolt pin.

The external mounting on aircraft of weaponry such as machine guns, rocket launchers and the like, particularly in retrofit applications, has heretofore carried with it a variety of structural, operational and safety limitations and disadvantages. As but one example, the external mounting of machine guns on a helicopter has previously entailed securing an outwardly projecting metal support tube to the helicopter and then mounting the gun on the tube. While this seems to be a fairly straightforward approach, unavoidable limberness in the support tube often leads to firing inaccuracies in the mounted gun due to wobbling of its firing axis relative to the aircraft. This firing axis misalignment is further aggravated by the shockabsorbing and gun alignment inefficiencies of conventional gun mounts used to secure the gun to the outwardly projecting support tube, the firing recoil of the gun typically increasing the wobble of its firing axis.

Another problem has been that conventional gun mounting apparatus has been undesirably heavy—a particularly undesirable characteristic in instances in which the guns are to be mounted on relatively light weight fixed wing aircraft.

Yet another problem is associated with conventional gun charging systems used to drive the machine gun's bolt pin between its "safe" and "armed" positions. These charging systems are typically pneumatically operated and positively drive the bolt pin between its safe and armed position. The relatively slow pneumatic driving of the bolt pin to its armed position tends to fairly frequently jam rounds in the gun's firing chamber. Moreover, the conventional use of pneumatic charging systems requires that at least one pressurized air vessel be carried on the aircraft. This, of course, adds appreciable weight to the overall armament weight which the aircraft must carry, and can additionally pose a serious safety problem in the event of pressure vessel rupture.

It is accordingly an object of the present invention to provide improved aircraft armament apparatus which eliminates or minimizes above-mentioned and other problems, limitations and disadvantages typically associated with conventional aircraft armament apparatus of this general type.

SUMMARY OF THE INVENTION

In carrying out principles of the present invention, in accordance with a preferred embodiment thereof, improved aircraft armament apparatus is provided which comprises an elongated support plank, preferably of a rigid honeycombed metal construction, that is transversely insertable through the rear cabin portion of the aircraft in a manner such that a longitudinally central portion of the support plank is disposed within the cabin area, and outer end portions of the plank project outwardly from opposite sides of the body of the aircraft. Means are provided for anchoring the central plank portion to the aircraft (which may be a helicopter or a fixed wing aircraft), and outer tip portions of the plank are pivotable between dully extended positions and upwardly and inwardly folded transport or storage positions. Secured to the outer ends of these foldable tip portions are downwardly projecting weaponry mounting structures which operatively carry a pair of multiple tube rocket launchers at their bottom ends. Adjustable alignment means are incorporated in the mounting structures and are operative to pivotally adjust the firing axes of the rocket launchers both vertically and laterally relative to the aircraft body.

Mounted on the undersides of the outwardly projecting plank end portions, inwardly of the foldable plank tips, are a pair of specially designed machine gun pods which are supplied with ammunition, in link belt form, from a pair of external magazines mounted within the aircraft cabin area. The ammunition belts from the two magazines are passed outwardly through the cabin, downwardly through openings formed through the plank end portions inwardly of the gun pods, and then outwardly into the machine guns carried within the pods.

Each of the gun pods includes a unique shock absorbing gun mount which incorporates principles of the present invention and comprises a rigid base plate bolted or otherwise suitably anchored to the underside of the plank, and a pair of elongated slide tubes secured to the underside of the plate in a laterally spaced and opposing parallel relationship. Spaced apart front and rear carriage members are slidably mounted to firmly anchored opposite end portions of the tubes and are intersecured by an intermediate carriage member having an opening therein through which an ammunition belt is fed to the gun supported by the mount.

A pair of hydraulic shock absorbers with internal return springs are positioned between the slide tubes, and between the front and rear carriage members, and are connected at their opposite ends to the front carriage member and a mounting member anchored to the underside of the base plate. A rear barrel portion of the gun is gimballed to the front carriage member, while a rear portion of the gun body is secured to the rear carriage member by a specially designed bore sighting and support mechanism which permits both vertical and side-to-side adjustment of the gun body to thereby selectively reposition the firing axis of the gun. The gun and its mounting structure are housed within a pod fairing structure which is securable to the gun mount base plate.

Due to the connection of each of the front and rear carriage members to two laterally spaced slide tube end portions, the predetermined alignment of the gun relative to its supporting structure is precisely maintained during operation of the gun. The relative axial alignment between the opposite end portions of a given slide tube is automatically maintained by the central portion of such tube.

Further, the shock absorbers, which are directly interconnected between the front carriage member and the base plate, smoothly and efficiently absorb the gun firing recoil forces which drive the front and rear carriage members rearwardly along their supporting slide tube end portions and are returned by the shock absorber springs. Coupled with the desirable rigidity of the support plank, this feature additionally reduces gun axis wobble during firing.

This precise maintenance of the gun axis in a predetermined orientation relative to the support structure is further enhanced by a unique bearing structure utilized at the slide tube - carriage member junctures. Specifically, in a preferred embodiment of the present invention, each of the openings in the front and rear carriage members, through which the slide tube end portions pass, has captively retained therein a bearing support which carries a spherical bearing member that circumscribes the slide tube within the carriage member opening. A tubular oilite bushing is press-fitted into the spherical bearing and slidably receives the slide tube end portion.

According to another aspect of the present invention, the problems and limitations commonly associated with pneumatically driven gun charging mechanisms are essentially eliminated by the provision of a unique electrically driven gun charging system which drives the gun's bolt pin to its "safe" position, but selectively frees it to be more rapidly returned, by its associated return spring, to its "armed" position.

In a preferred embodiment thereof, the gun charging system comprises an actuating member which is drivable between first and second positions. The actuating member, during driven movement toward its second position, engages the bolt pin and drives it to its safe position, against the biasing force of its associated return spring, when the actuating member reaches its second position.

Electric drive means are provided and are selectively operable to drive the actuating member in opposite directions between its first and second positions. Latch means operate to engage and releasably hold the bolt pin in its safe position in response to movement of the actuating member to its second position. The latch means are further operative to hold the bolt pin in its safe position during electrically driven return movement of the actuating member from its second position toward its first position. Release means, operative in response to driven return movement of the actuating member to its first position, cause the latch means to be disengaged from the bolt pin to permit the bolt pin to be rapidly moved, by its return spring, from its safe position to its armed position, thereby essentially eliminating ammunition jamming problems commonly associated with conventional pneumatically driven machine gun charging systems.

In the preferred embodiment of the electric charging system, the latch means include a pivotally mounted latch member which, with the actuating member in its second position, is held in its bolt pin-retaining position by both the actuating member and a movable sear member which operatively engages the latch member, thereby providing a desirable double safety lock on the bolt pin in its safe position.

The electrical gun charging system of the present invention, compared to conventional pneumatic charging systems, is lighter in weight, operationally safer, and more reliable. Additionally, the gun pod, with its unique shock absorbing gun mount, provides a variety of improvements over conventional aircraft mounted gun pods of this general type. Coupled with the specially designed plank mounting system described above, the pod also provides substantial improvements in the overall aircraft armament apparatus.

While the improved gun pod is preferably mounted on the described support plank structure, it may also, of course, be mounted on a somewhat shorter plank without the folding tip portions or the auxiliary weaponry support structure associated with such tip portions. Alternatively, the pod could be mounted on a first wing pylon of a fixed wing aircraft and supplied with ammunition from an external magazine adjacent the pod and carried by a second wing pylon.

BRIEF DESCRIPTION OF THE DRAWINGS

FIGS. 17–19 are partially sectioned fragmentary side elevational views of the charging mechanism sequentially illustrating its interaction with and control of the gun's bolt pin;

DETAILED DESCRIPTION

Figure 1:
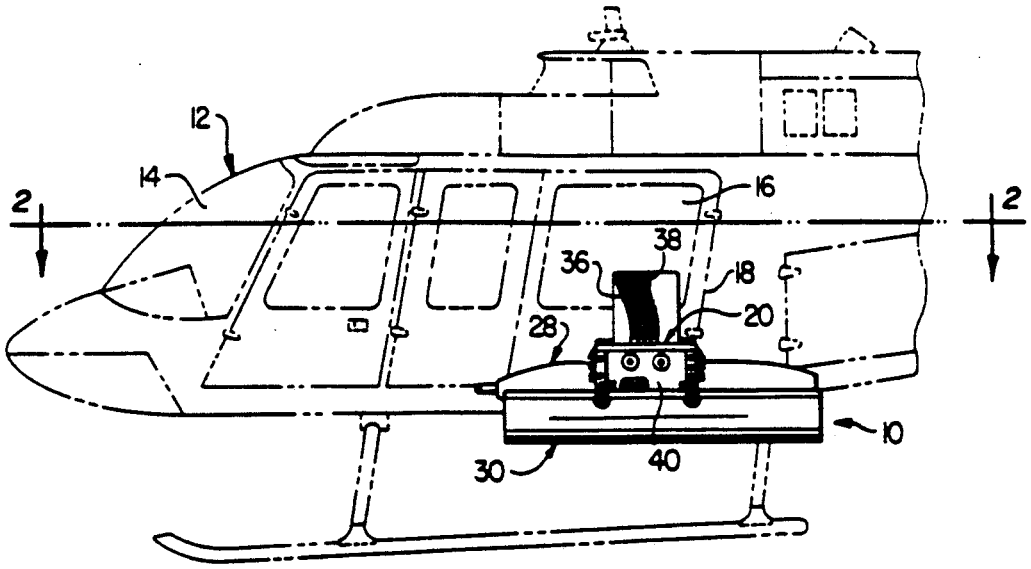
FIG. 1 is a partial side elevational view, in phantom, of a representative helicopter to which is operatively secured improved armament apparatus of the present invention that comprises an elongated armament support plank member carrying a pair of machine gun pods and a pair of multiple rocket launching tubes.
Figure 2:
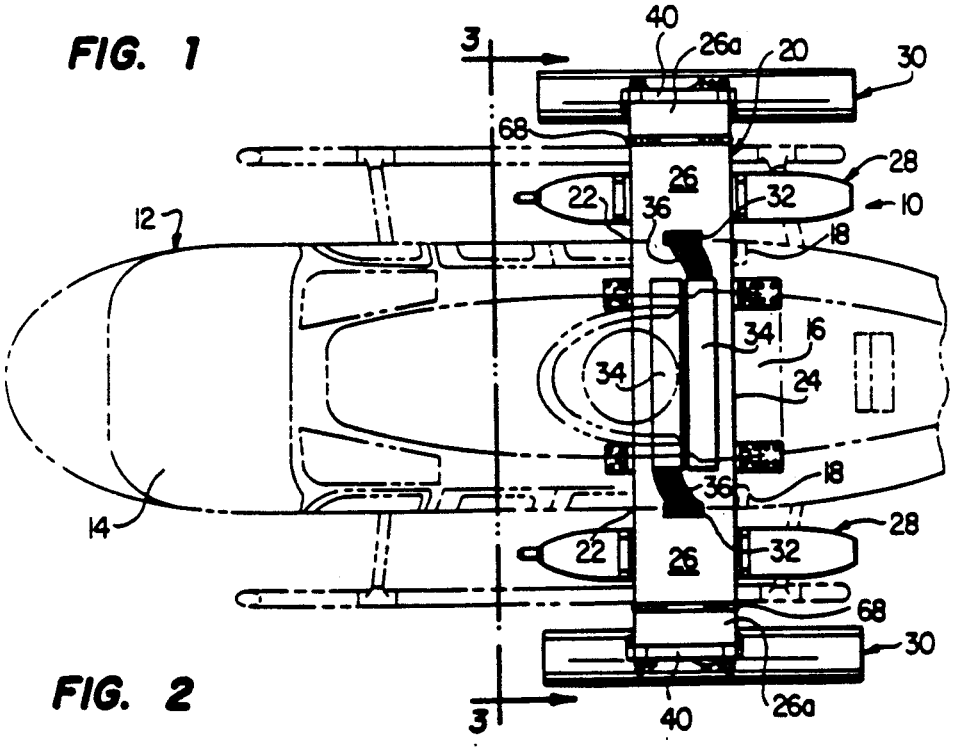
FIG. 2 is a cross-sectional view through the helicopter taken along line 2—2 of FIG. 1.
Figure 3:
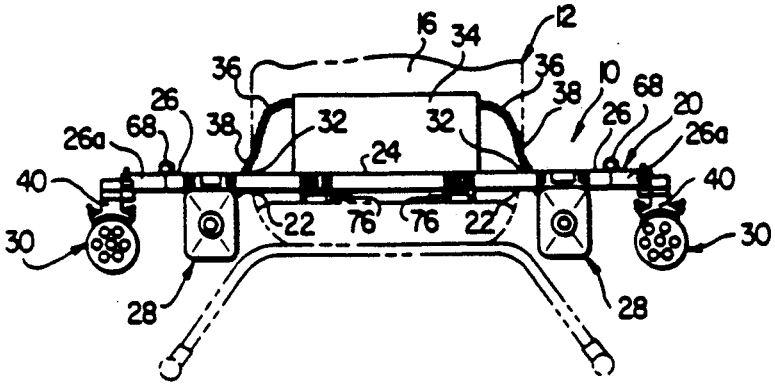
FIG. 3 is a partial cross-sectional view through the helicopter taken along line 3—3 of FIG. 2.

Referring initially to FIGS. 1–4, the present invention provides improved armament apparatus 10 which is operatively connected to a representative helicopter 12 having a cockpit area 14 positioned forwardly of a cabin area 16 provided with rear doors 18. The armament apparatus 10 includes an elongated metal support plank member 20 which is extended transversely through the cabin area 16, through suitable openings 22 formed in the helicopter body, and has a central longitudinal portion 24 which is anchored to the interior cabin structure in a manner subsequently described. Outer end portions 26 of the support plank 20 project outwardly from opposite sides of the helicopter body and have anchored to their lower sides a pair of specially designed machine gun pods 28 positioned adjacent the opposite sides of the helicopter body, and a pair of multiple tube rocket launchers 30 positioned outwardly of the gun pods 28 on outer tip portions $26_a$ of the support plank 20.

Figure 4:
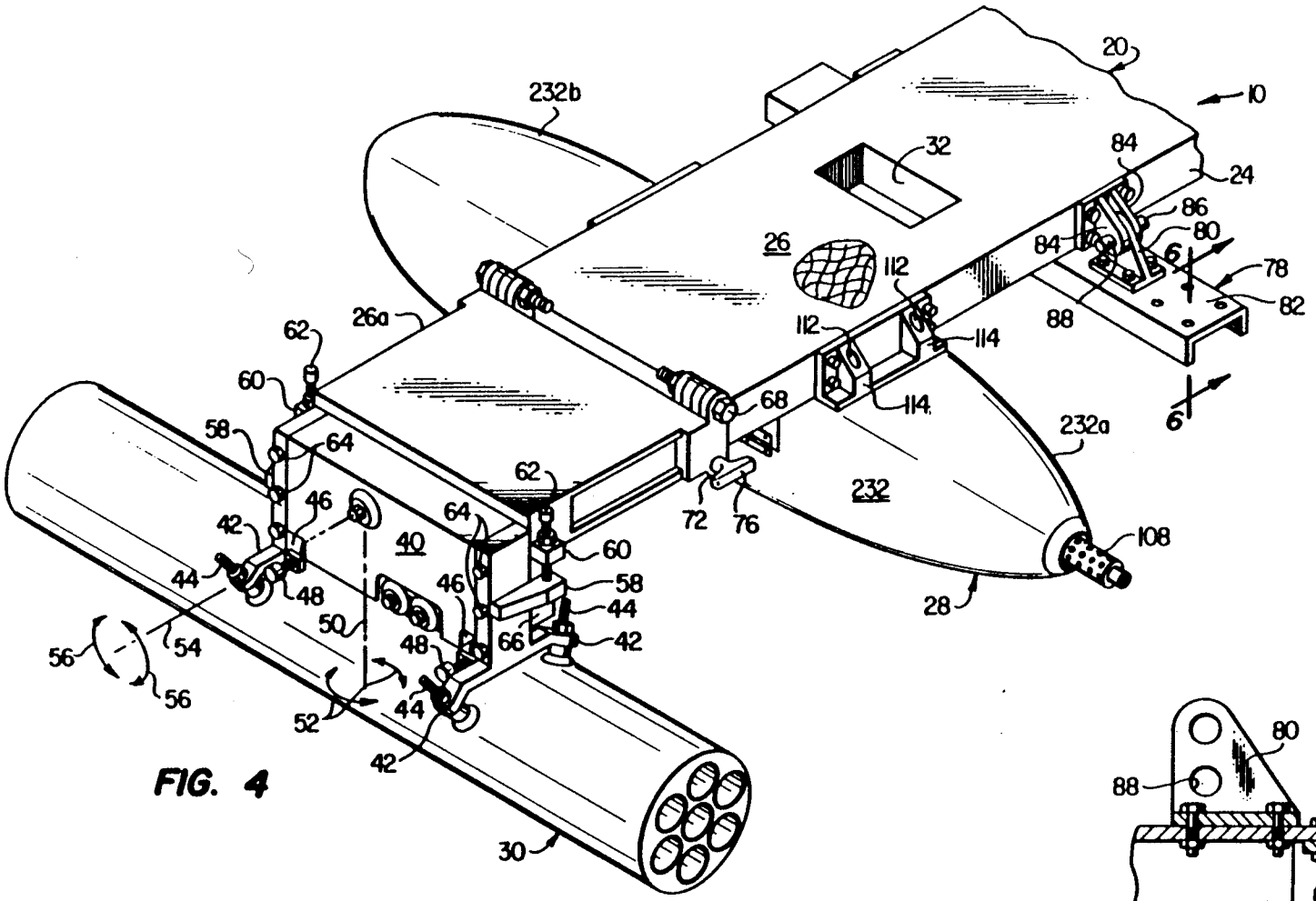
FIG. 4 is an enlarged perspective view of a left half of the armament mounting structure as viewed in FIG. 3.
Figure 6:
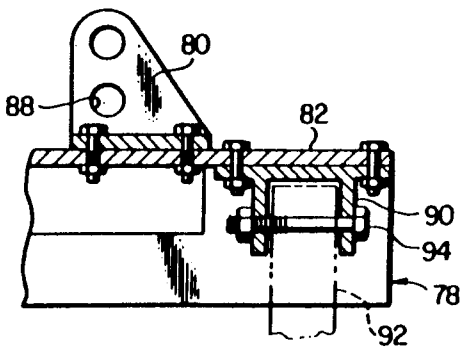
FIG. 6 is an enlarged scale partial cross-sectional view through a plank mounting channel portion of the armament mounting structure taken along line 6—6 of FIG. 4.

As shown in FIG. 4 the support plank 20 is of a reinforced, rigid "honeycomb" metal construction and has formed through its outer end portions 26 a pair of rectangular ammunition belt openings 32 positioned adjacent the opposite sides of the helicopter body. The gun pods 28 are supplied with ammunition from a pair of external magazines 34 positioned within the cabin area 16 and mounted atop the central portion 24 of the support plank 20. The machine gun ammunition belts 36 are passed outwardly from the magazines 34 through suitable openings 38 in the cabin doors 18 and are extended downwardly through the support plank openings 32 into the gun pods 28.

Secured to the outer ends of the plank sections $26_a$ are a pair of downwardly projecting, generally rectangularly shaped weaponry support structures 40 having at each of their opposite ends a pair of outwardly projecting support arms 42 which, in a conventional manner straddle upper surface portions of the rocket launchers 30 and are provided with threaded support elements 44 which bear against the launchers. Each of the rocket launchers 30 is provided with front and rear mounting shackles (not shown) which are snapped into suitable openings 46 formed on the bottom side of each of the support structures 40. On opposite sides of each of these openings 46 a pair of threaded adjustment members 48 are provided which bear against the mounting shackles and are adjustable to selectively vary the rotational orientation of the particular launcher about a vertical axis 50 as indicated by the double ended arrows 52 in FIG. 4.

Each of the support structures 40 is mounted on its associated outer end of one of the plank sections $26_a$ for pivotal motion about an axis 54 which extends parallel to the length of the support plank 20. Elevational adjustments of each of the rocket launchers 30 about the particular axis 54, as indicated by the double ended arrows 56, is provided by a pair of adjustment blocks 58 secured to opposite ends of the support structure 40, a pair of adjustment blocks 60 secured to the outer end of the plank section $26_a$, and adjustment bolt members 62 threaded downwardly through the adjustment blocks 60 and bearing at their lower ends against the adjustment blocks 58.

By appropriately adjusting the bolts 62 (i.e., by loosening one and tightening the other) the elevational firing angle of the rocket launcher 30 can be easily and quickly adjusted. The launcher 30 may be locked in its elevationally adjusted position by means of lock screws 64 threaded into opposite ends of the support structure 40 and bearing at their inner ends against a downwardly projecting portion 66 of the plank section $26_a$. It can thus be seen that the firing axis of each rocket launcher 30 may be quickly and easily adjusted elevationally and in a side-to-side manner by simply using the adjustment elements 48 and 62.

Figure 5:
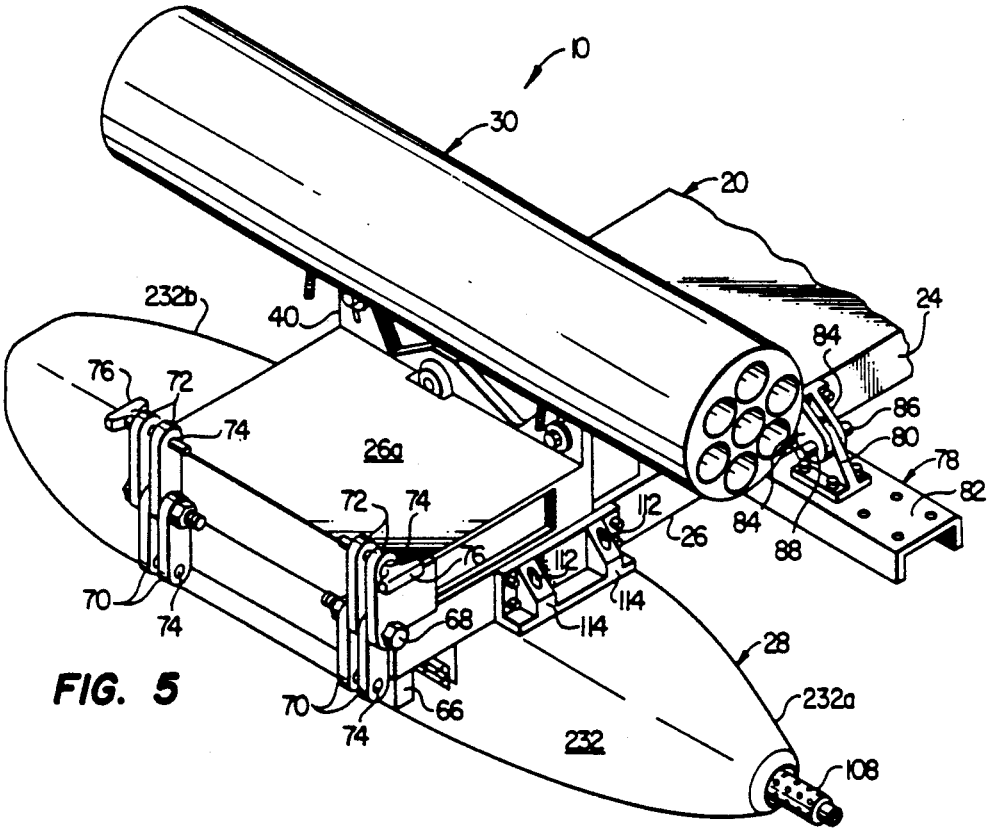
FIG. 5 is a view similar to that in FIG. 4, but illustrating an outer tip portion of the support plank member in an inwardly folded position thereof.

As illustrated in FIGS. 4 and 5, each of the outer plank end sections $26_a$ is pivotally connected to its associated plank section 26 at a point 68 intermediate the gun pod 28 and the rocket launcher 30. On opposite sides of the pivot point 68 the plank sections 26 and $26_a$ are provided with tab pairs 70 and 72 which have openings 74 formed in outer end portions thereof. When the outer plank sections $26_a$ are in their "extended" position depicted in FIG. 4, the adjacent sets of tab pairs 70 and 72 are interlocked to bring the tab openings 74 into alignment. The plank sections $26_a$ are locked in these extended positions by suitable pin elements 76 extended through the aligned tab openings in the interlocked tab pairs.

However, by removing the locking pins 76, the outer plank end sections $26_a$ may be swung upwardly about their pivot points 68 and rested upon the upper surface of the plank sections 26 as depicted in FIG. 5. In this inwardly folded configuration, the overall length of the armament apparatus 10 is substantially reduced to facilitate loading of the helicopter onto a transport aircraft or the like. The folded over plank sections $26_a$ may be suitably locked in this folded orientation and then quickly pivoted outwardly to and locked in their extended positions as previously described.

The central longitudinal section 24 of the support plank 20 is secured to the helicopter 12, within its rear cabin area 16, by means of a pair of support channels 78 which are best illustrated in FIGS. 3–6. Support channels 78 are positioned beneath the support plank section 24 and are anchored to the plank by means of mounting flanges 80 secured to the upper wall 82 of each channel 78 adjacent its opposite end. The flanges 80 are received between pairs of flanges 84 secured to opposite side edges of the plank 20 and are anchored thereto by means of lock pin elements 86 extended through aligned openings 88 formed through the flanges 80 and 84. Secured to the underside of the upper wall 82 of each of the support channels 78, adjacent its opposite ends, are mounting channels 90 (FIG. 6) which extend transversely to the channels 78. These mounting channels 90 each receive an upstanding flange 92 (FIG. 6) which is anchored to the floor structure of the helicopter within the cabin area 16. The channels 90 are anchored to the upstanding flanges 92 by means of suitable anchor bolt members 94.

Referring now to FIGS. 7–12, each of the gun pods 28 is of a unique construction which features a specially designed, shock-absorbing gun mount 100 that incorporates principles of the present invention, is mounted on the support plank 20 in a manner subsequently described, and is utilized to support a machine gun 102 (FIG. 7) having an elongated, generally rectangular body portion 104 with a front end 106 from which the gun's barrel portion 108 forwardly projects.

The gun mount 100 includes an elongated rectangular metal deck plate 110 which is transversely secured to the underside of the support plank 20 (FIG. 4) by means of bolt members 112 extended downwardly through support lugs 114 on the opposite side edges of the plank and threaded into the deck plate. Alternatively, the upper side of the deck plate could be provided with conventional bomb lugs which are connectable to the corresponding support structure on a bomb rack or the like.

Positioned closely beneath the deck plate 110 are a pair of elongated metal slide tube members 116 and 118 which are spaced apart from and extend parallel to one another, and are parallel to the length of the plate 110. The front ends of the tubes 116, 118 are extended through an elongated front slide tube support member 120 anchored to the underside of the deck plate 110 by bolts 122, while the rear ends of the tubes are extended through an elongated rear slide tube support member 124 which is anchored to the underside of the deck plate by means of suitable bolt 126. The opposite outer ends of the slide tubes 116, 118 extend outwardly through the end support members 120, 124 and are threaded into cylindrical retaining members 128. Tubes 116 and 118 are additionally extended through front and rear pairs of intermediate support members 130 and 132 which are respectively positioned inwardly from the front and rear support members 120, 124 and are anchored to the underside of the deck plate 110.

The front slide tube end portions $116_a$ and $118_a$ positioned between the support members 120 and 130 are extended through and slidably carry an upper end portion of a downwardly projecting front carriage member 134. In a similar manner, the rear slide tube end portions $116_b$ and $118_b$ positioned between the support members 124 and 132 are extended through and slidably carry an upper end portion of a downwardly projecting rear carriage member 136. Front and rear carriage members 134 and 136 are fixedly secured to the opposite ends of an elongated rectangular intermediate carriage member 138 which is positioned beneath the slide tubes 116 and 118, is laterally tilted at an angle of approximately 45°, and is provided with a rectangular slot 140 therein through which ammunition is supplied to the gun 102, the gun being mounted on and carried by the carriage members 134, 136 in a manner subsequently described.

The firing recoil of the gun 102 is absorbed and damped by a pair of elongated hydraulic shock absorbing members 142 and 144 which are provided with internal return spring elements as at 145. The shock absorbers are positioned between the slide tubes 116 and 118, and are operatively interconnected between the front carriage member 134 and the deck plate 110 by means of a support block member 146 anchored to the rear surface of the front carriage member and an intermediate support block member 148 positioned between the slide tubes and the carriage members and anchored to the underside of the deck plate by suitable bolts 150.

Figure 10:
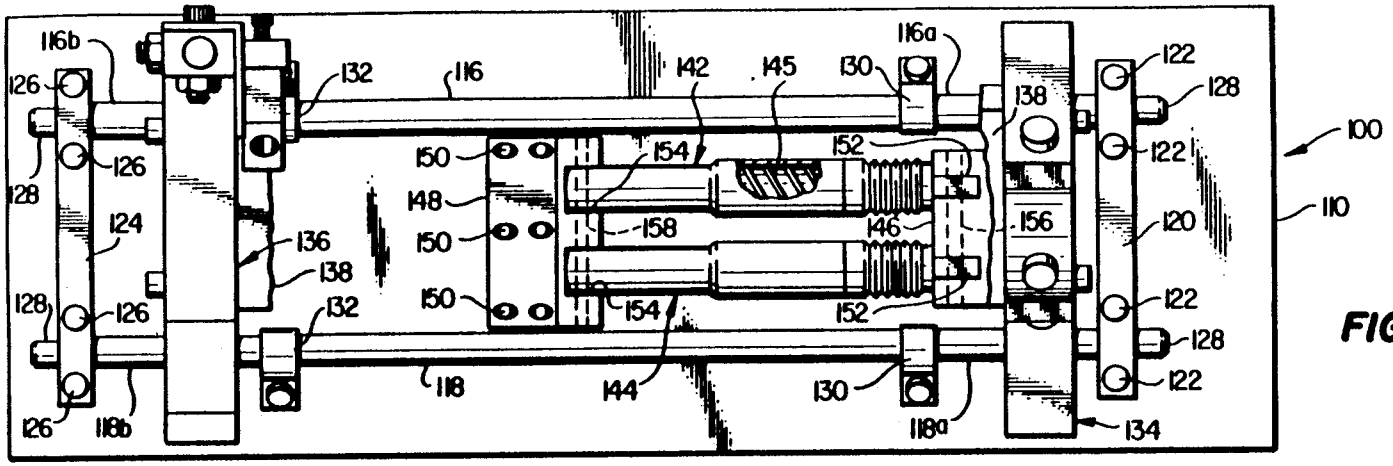
FIG. 10 is an enlarged bottom plan view of the gun mounting assembly.
Figure 11:
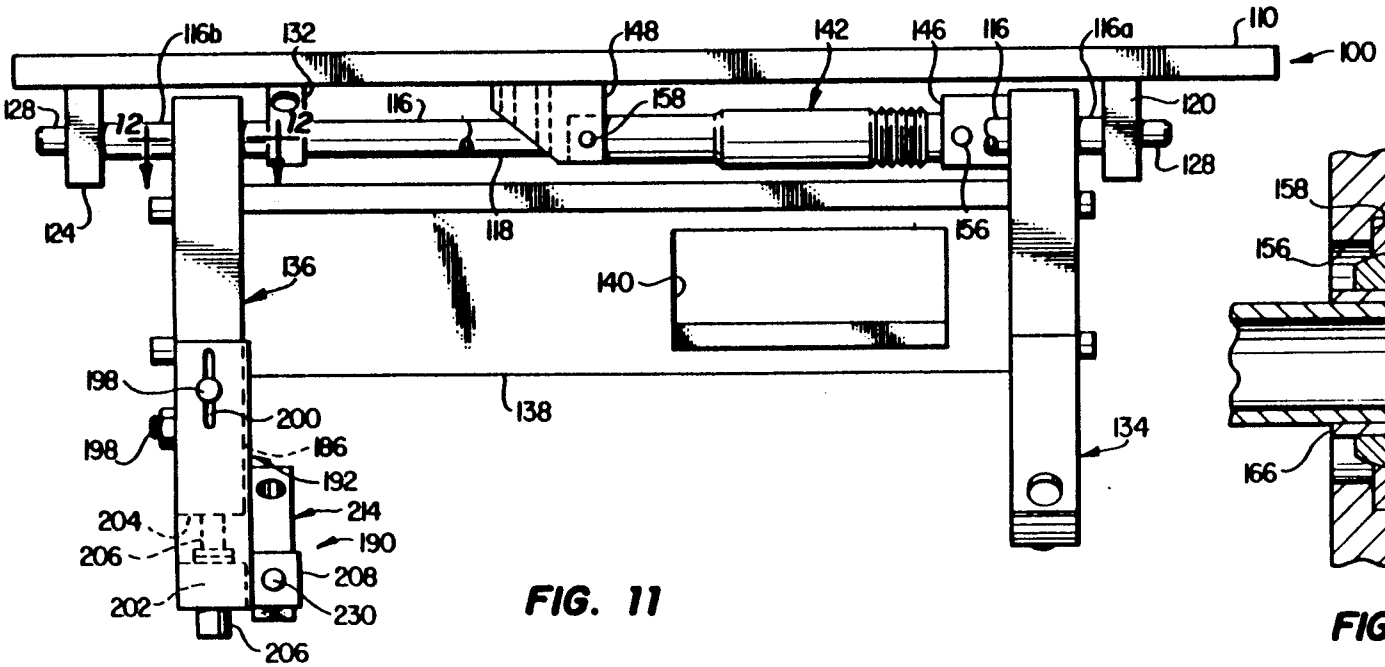
FIG. 11 is a partially cut away side elevational view of the gun mounting assembly.

As best illustrated in FIG. 10, opposite end portions of the shock absorbers 142, 144 are received in openings 152 formed in the support block 146, and openings 154 formed in the intermediate support block 148, and are retained in such openings by suitable bolt members 156 and 158. It can be seen that a rearwardly directed recoil firing force of the gun 102 drives the front and rear carriage members 134, 136 rearwardly along the slide tube portions $116_a$, $118_a$ and $116_b$, $118_b$ upon which the carriage members are slidably mounted. The gun recoil forces transmitted to the rearwardly moving carriage members are absorbed and damped by the shock absorbers 142 and 144 which are axially compressed during the carriage member recoil movement, the internal shock absorber springs 145 returning the shock absorbers to their extended position at the termination of such recoil forces.

Figure 12:
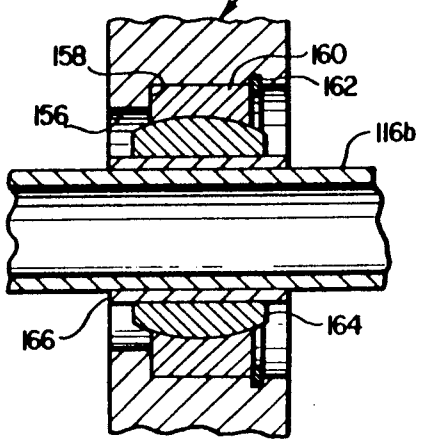
FIG. 12 is an enlarged scale cross-sectional view through a carriage member and associated slide tube portion of the gun mounting assembly taken along line 12—12 of FIG. 11.
Figure 13:
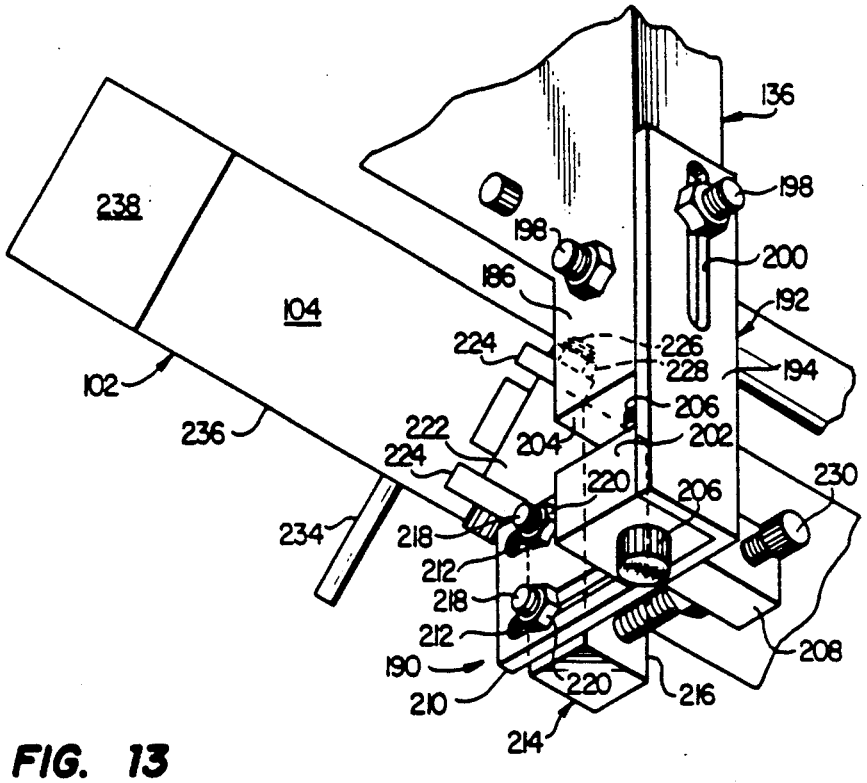
FIGS. 13 and 14 are enlarged scale perspective views illustrating the connection of a bore sighting mechanism portion of the assembly to a rear section of the gun.
Figure 14:
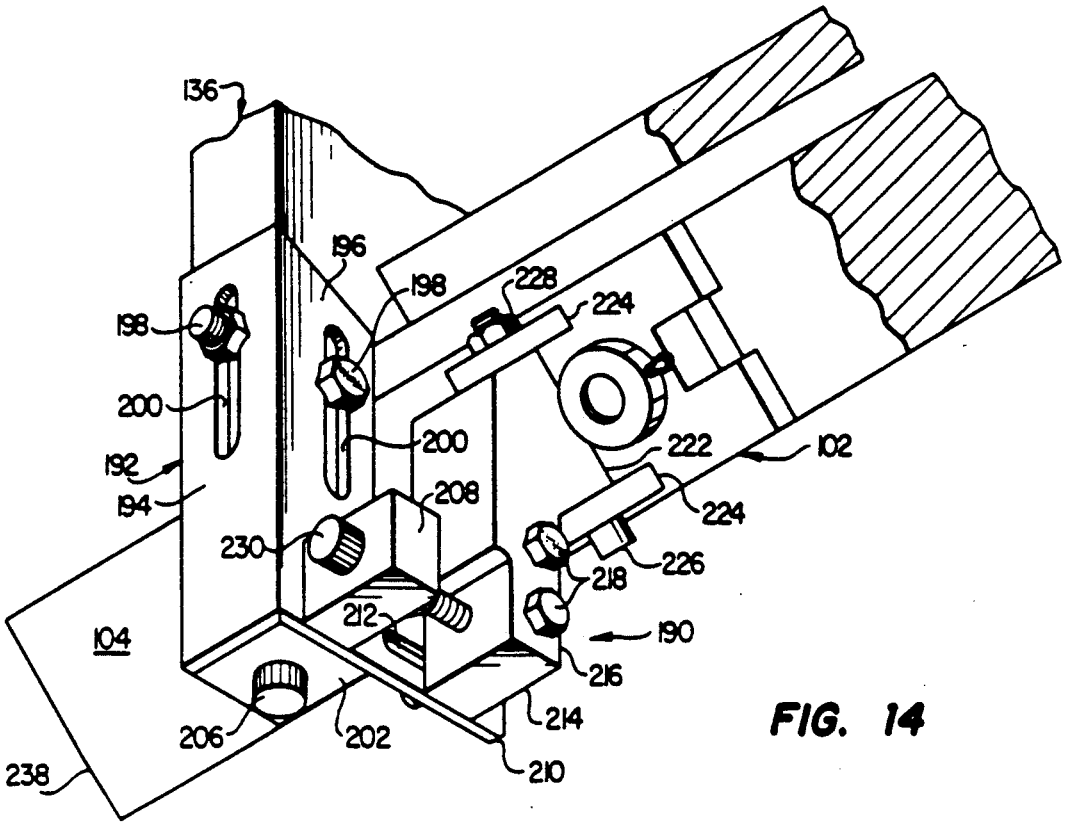

As representatively depicted in FIG. 12, the front and rear carriage members 134, 136 are slidably mounted on the tube end portions in a manner which significantly facilitates the maintenance of the proper alignment between the carriage members and the axes of the slide tubes. Specifically, each of the slide tube end sections (for example section $116_b$ in FIG. 12) is extended through an opening 156 formed in its associated carriage member portion. The opening 156 internally defines an annular ledge 158 against which a spherical bearing support member 160 is captively retained by means of a snap ring 162. The support member 160 internally carries a spherical bearing element 164 into which a cylindrical oilite bushing 166 is coaxially press-fitted, the bushing slidably receiving its associated slide tube end portion. With the carriage members mounted on the slide tube end portions in this fashion, the four spherical bearing cooperate to maintain precise alignment of the carriage members with the tube axes during the axial travel of the carriage members along the tubes, while the bushings 166 provide for smooth sliding movement of the carriage members along the tube end portions.

Figure 7:
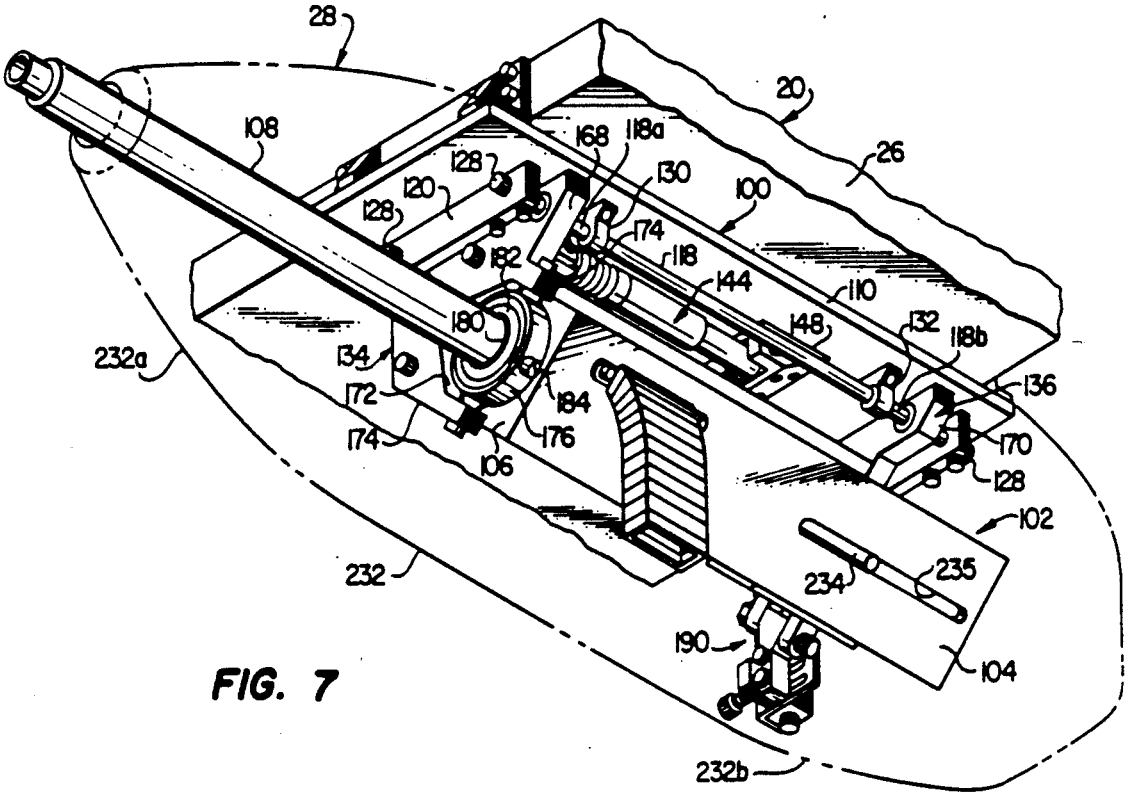
FIG. 7 is a perspective view of one of the machine guns which is supported in a specially designed gun mounting assembly of the present invention, the assembly being secured to the underside of the support plank and enclosed within a pod fairing illustrated in phantom, an electric gun charging mechanism of the present invention being removed from the gun for illustrative clarity.
Figure 8:
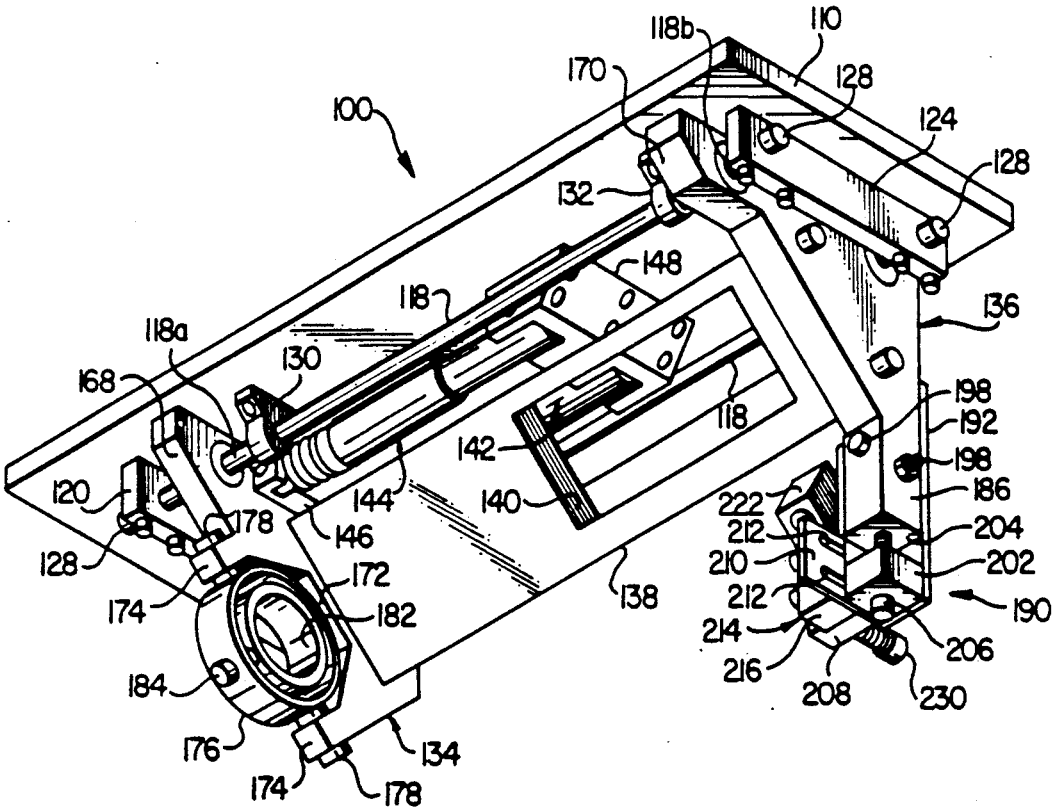
FIG. 8 is a perspective view of the gun mounting assembly of FIG. 7, with the gun and pod fairing removed therefrom.
Figure 9:
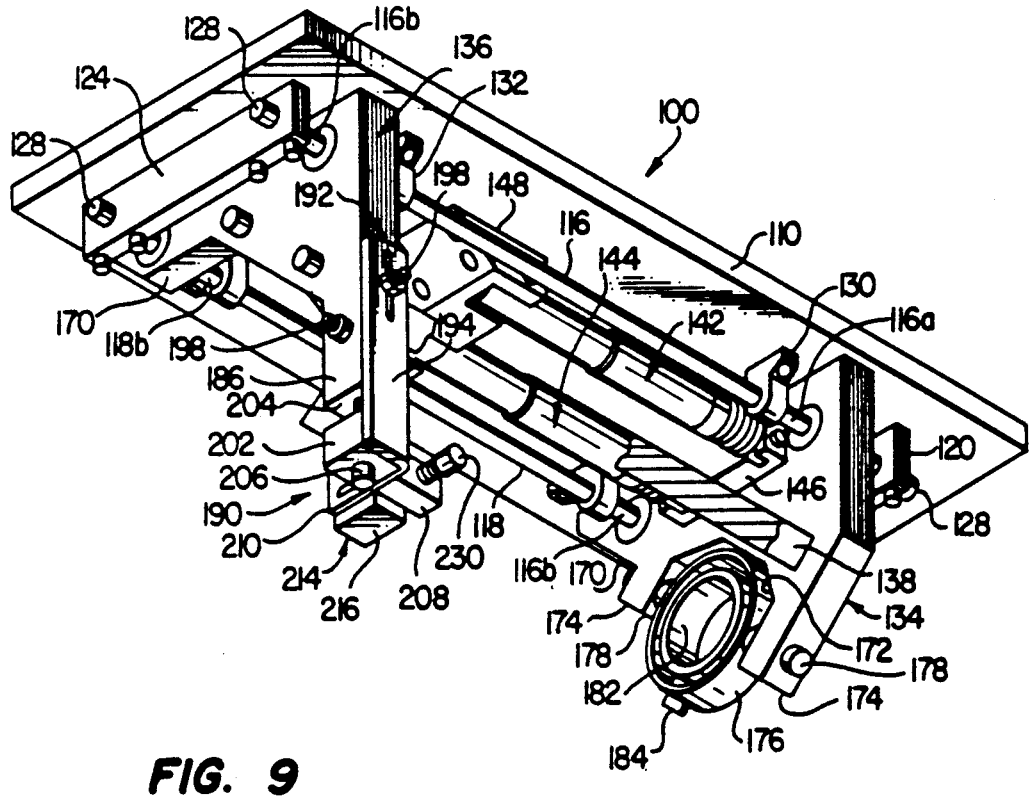
FIG. 9 is a partially cut away rear side perspective view of the gun mounting assembly of FIG. 8.

Referring now to FIGS. 7-9, the front and rear carriage members 134, 136 are each of a generally triangular configuration and have downwardly and laterally sloped side surfaces 168 and 170. A lower end portion of the front carriage member side surface 168 is inwardly recessed as at 172, the recess 172 being positioned between a pair of outwardly projecting support arm portions 174. A gimbal ring member 176 is received within the front carriage member recess 172 and is pivoted therein by a pair of bolts 178 extended through the support arms 174 and secured at their inner ends to opposite sides of the gimbal ring. Adjacent its juncture with the front end 106 of the gun body 104, the barrel portion 108 is provided with an externally threaded annular flange 180 (FIG. 7) which is threaded into an annular trunnion member 182. Trunnion member 182 is pivotally mounted within the gimbal ring 176 by means of a bolt 184 extending through the gimbal ring perpendicularly to the axes of the bolts 178 and connected to one side of the trunnion member. An opposite side portion of trunnion member is pivoted within the gimbal ring by means of an internal support post (not shown) extending from the interior surface of the gimbal ring into the trunnion member. Accordingly, the gun 102 is gimballed on the front carriage member, adjacent the juncture of the barrel and body portions of the gun, by means of the gimbal ring and trunnion member, for pivotal motion about two mutually perpendicular axes relative to the front carriage member.

The rear carriage member 136 terminates at its lower end in a support post portion 186 having a rectangular cross-section. Support post 186 forms a portion of a bore sighting assembly 190 which, in a manner subsequently described, is utilized to adjustably vary the firing axis of the gun 102.

Referring now to FIGS. 8, 9, 11, 13, and 14, the bore sighting assembly 190 includes an elongated channel member 192 having an L-shaped cross-section defined by perpendicular side walls 194 and 196. An upper end portion of the channel member 192 is mounted on two perpendicular side walls of the support post 186 for adjustable vertical movement relative thereto by means of a pair of bolts 198 extended through slots 200 in the side walls 194, 196 and into the support post. An adjustment block 202 is welded to the lower end of the channel member 192 and is spaced downwardly from the lower end 204 of the support post 186. A vertical adjustment bolt 206 is extended upwardly through the adjustment block 202 and is threaded into the lower end 204 of the support post. For purposes subsequently described, the channel member 192 may be adjustably locked in a selected vertical position relative to the support post 186 simply by loosening the bolts 198, rotating the bolt 206 in an appropriate direction to move the channel member 192 upwardly or downwardly along the support post, and then retightening the bolts 198.

Projecting outwardly from a lower end portion of the channel member side wall 196 is an adjustment block 208 and a flange 210 having a pair of horizontally extending slots 212 formed therethrough. A gun mounting member 214 has a lower end portion 216 which is secured to the flange 210 for horizontal movement relative thereto by means of a pair of tightening bolts 218 which are extended through the mounting member portion 216 and the slots 212, and are secured to appropriate fastening nuts 220 on the opposite side of the flange 210.

An enlarged upper portion 222 of the gun mounting member 214 is received between a pair of mounting lugs 224 secured to the lower side of the gun body 104 and is secured to such lugs by a connecting bolt 226 which extends through the lugs and the mounting member portion 222 and is threaded into a nut 228. A horizontal adjustment bolt 230 is extended inwardly through the adjustment block 208 and is threaded into the lower portion 216 of the gun mounting member 214. Accordingly, a rear portion of the gun may be horizontally pivoted about the previously described front gimbal ring mounting structure simply by loosening the bolts 218 and then rotating the horizontal adjustment bolt 230 to move the gun mounting member 214 inwardly or outwardly along the flange 210, and then retightening the bolts 218 to re-lock the gun in its horizontally adjusted position.

In a similar fashion, the gun may be vertically pivoted about the front gimbal support structure by utilizing the tightening bolts 198 and the vertical adjustment bolt 206 as previously described. In this manner the gun may be quickly and easily bore sighted by adjustably pivoting it about two mutually perpendicular axes—namely the axis of the gimbal ring bolts 178 (FIG. 8) and the trunnion bolt 184.

As illustrated in FIGS. 4 and 7, the gun mount 100 and the machine gun 102 which it operatively supports, are housed within a molded plastic fairing structure 232 which has removably intersecured front and rear sections $232_a$ and $232_b$ that are appropriately secured to the deck plate 110. While the fairing structure 232 is conveniently formed from a light weight molded plastic material, it could alternatively be formed in other manners such as from a metal skeleton covered with a suitable fabric or rigid panel sections. Additionally, particularly for relatively low speed flights, the fairing structure could be eliminated altogether.

The shock-absorbing gun mount 100 just described provides a variety of advantages over conventional machine gun mounts of this general type. For example, it is significantly lighter and, due to its relatively simple construction, is easier to field maintain. The bore sighting of the mounted machine gun is easily and quickly adjusted and is precisely maintained during gun operation due to the very firm support of the carriage members on opposite ends of the slide tube pairs which substantially preclude appreciable pivotal motion of the carriage members about axes parallel or perpendicular to the tube axes. Each tube end portion is, of course, automatically held in precise alignment with its opposite end portion counterpart by the central portion of the particular slide tube. This maintenance of precise carriage member alignment is further facilitated by the previously described spherical slide bearing structure, which substantially reduces slide variance, and the very rigid construction of the support plank.

Additionally, the direct interconnection between the front carriage member and the rigid deck plate by the hydraulic shock absorbers, as described above, substantially reduces adverse effects of the gun firing recoil load transmitted to the aircraft. Finally, the configuration of the gun mount conveniently permits the supported gun to be supplied with ammunition from an external magazine as previously described herein.

Figure 15:
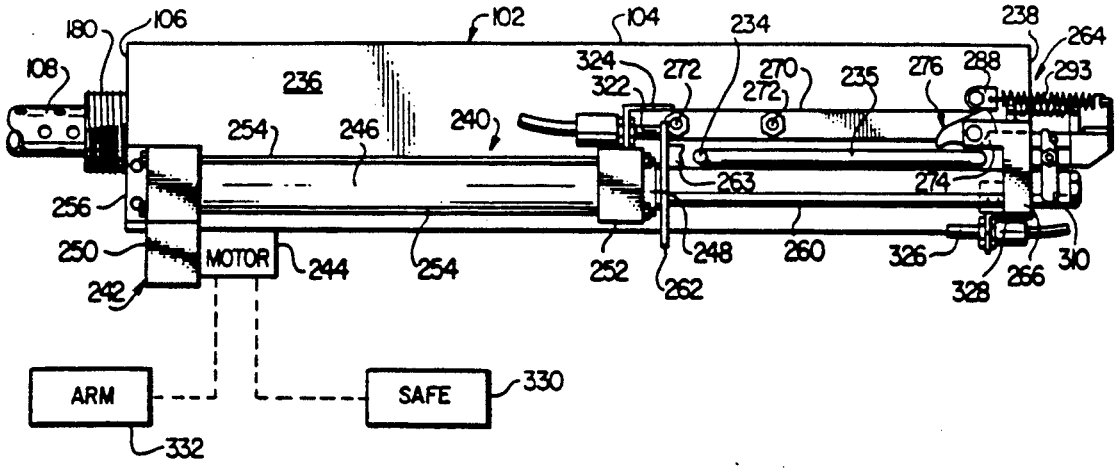
FIG. 15 is a fragmentary, partially schematic and somewhat simplified side elevational view of the gun with the electric charging mechanism of the present invention operatively connected thereto.
Figure 16:
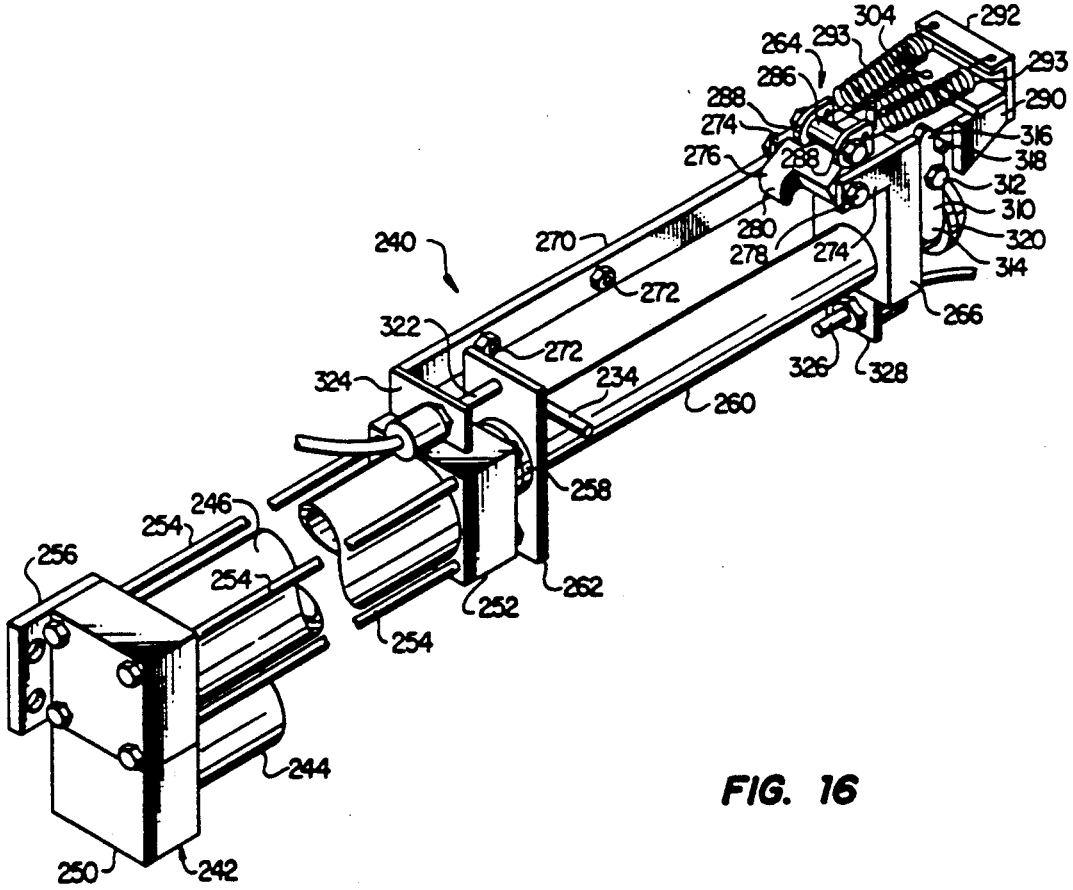
FIG. 16 is an enlarged scale perspective view of the charging mechanism and the gun's bolt pin which it operates.

Referring now to FIGS. 15–17, the gun 102 is a .50 caliber machine gun, but could alternatively be a machine gun or cannon of another size or type. The gun is provided with a bolt pin 234 which projects outwardly through a slot 235 formed through the side surface 236 of the gun body 104 adjacent its rear end 238. To operate the bolt pin in a manner subsequently described, the present invention provides a uniquely configured and operative gun charging assembly 240 which is secured to the side surface 236 of the gun body 104.

The charging assembly 240 includes a generally conventional linear electric actuator 242 that comprises an electric motor 244, a cylindrical housing 246 having an actuating rod 248 disposed therein for axial movement relative thereto, a drive housing structure 250 which interconnects end portions of the motor 244 and the housing 246 and has a drive system therein which drivingly interconnects the motor 244 and the rod 248, and a generally rectangularly shaped support block member 252 positioned on the outer end of the housing 246 and intersecured to the drive housing structure 250 by support rods 254 interconnected between the elements 250, 252. Via the drive system disposed within the drive housing 250, operation of the motor 244 in opposite directions causes outward axial extension of the rod 248, or inward retraction thereof as the case may be, relative to the housing 246. The drive housing 250 has secured thereto a suitable mounting bracket 256 which is bolted to the side 236 of the gun body 104 adjacent the front end 106 of the gun body.

The right or outer end of the actuating rod 248 is coaxially secured, by means of a coupling element 258, to the inner end of an elongated extension rod 260. Positioned forwardly (i.e., leftwardly) of the bolt pin 234 is a rectangular push plate 262 which is secured to the rod 260, the push plate 262 having a small push block 263 welded to its rear side surface and movable into engagement with the bolt pin 234 in response to rightward axial movement of the interconnected rods 248 and 260.

Spaced rearwardly from the push plate 262 along the side surface 236 of the gun body is a latch mounting assembly 264 that includes a generally L-shaped mounting block member 266 which, adjacent its lower end, is bolted to the gun body as at 268. Mounting block member 266 and the support block member 252 are secured to opposite ends of an elongated mounting bar 270 which is secured to the side 236 of the gun body as at points 272. The upper portion of the mounting block member 266 is defined by a pair of forwardly projecting arms 274 between which a latch member 276 is pivoted upon a pin 278 which is extended through the arms 274 and the latch member. The latch member 276 has a curved outer end holding portion 280, and a pair of stop engagement surfaces 282 and 284 which are circumferentially spaced apart from one another and from the latch holding portion 280, the stop surface 282 being positioned circumferentially between the end portion 280 and the stop surface 284. Transversely secured to an upper surface portion of the latch member 276 is a tube 286 having a pair of plates 288 secured to its outer ends.

Referring now to FIGS. 16 and 17, a rear portion 290 of the latch mounting assembly 264 is provided with an upwardly projecting, generally L-shaped holding member 292 which is connected to the plates 288 by a pair of spring elements 293 that bias the latch 276 in a clockwise direction about the pivot pin 278. An elongated sear plate 294 has a central portion slidably received within an opening 296 formed through the mounting block 266, a front end portion 298 engageable with one of the stop surfaces 282, 284 of the latch member 276, and a rear end portion 300 positioned under a retaining wall 302 mounted on the rear portion 290 of the latch mounting assembly 264. The sear plate 294 is forwardly or leftwardly biased toward the latch member 276 by means of a spring element 304 connected at its opposite ends to a mounting member 306 secured to an upper end portion of the mounting block member 266, and a mounting member 308 secured to the rear end portion 300 of the sear for movement therewith.

A pair of elongated release cams 310 are pivotally connected by a pin 312 to the rear portion 290 of the latch mounting assembly 264 rearwardly of the mounting block member 266 and forwardly of the retaining wall 302. Each of the release cams 310 has a body portion 314 positioned below the pin 312, and a narrower tab portion 316 projecting upwardly from the body 314 and positioned forwardly of a dowel pin 318 extending through and projecting outwardly from opposite side edge surfaces of the sear plate 294.

The extension rod 260 is slidably extended through the mounting block member 266 and has secured to its outer or right end a release member in the form of an annular flange 320 which is positioned rightwardly of the bodies 314 of the release cams 310. For purposes later described, a front limit switch 322 is mounted on a support frame 324 secured to the support block member 252 forwardly of the push plate 262, and a rear limit switch 326 is secured to a support frame 328 attached to the underside of the mounting block member 266.

In a manner subsequently described, the charging assembly 240 functions to cause selective movement of the gun's bolt pin 234 forwardly and rearwardly along the gun body slot 235 in response to the actuation of "safe" and "arm" controls 330 and 332 operatively connected to the charging assembly motor 234 as schematically depicted in FIG. 15. Prior to operation of the gun 102, rearward movement of the bolt pin 234 (from its forwardmost position depicted in FIG. 15) along the slot 235 to the rear end of the slot is resisted by an internal bolt pin return spring (not shown) which leftwardly biases the pin. Movement of the bolt pin to the right end of the slot moves the pin to its "safe" position in which the gun is precluded from firing. Subsequent leftward movement of the pin to its forwardmost position arms the gun and readies it for firing. This initial pre-firing rightward and subsequent leftward movement of the bolt pin 234 is conventionally accomplished utilizing a pneumatic charging system which pneumatically drives the bolt pin rightwardly and then leftwardly to arm the gun. This conventional use of a pneumatically powered charging system carries with it a number of well known disadvantages and limitations.

For example, the use of such conventional pneumatic charging system requires that compressed air vessels be carried on the aircraft. This not only undesirably adds to the weight which the aircraft must carry, but creates a safety hazard as well in the event that the pressurized air storage vessel is ruptured. Additionally, it has been found that pneumatically driving the bolt pin 234 leftwardly to its armed position frequently causes jamming of the initial round in the chamber because of the relatively slow penumatically driven chambering motion imparted thereto.

The electric charging assembly 240, of course, eliminates the necessity of carrying high pressure air storage air vessels on the aircraft for gun charging purposes, and additionally operates in a manner essentially eliminating the jamming problems associated with pneumatic systems in a manner which will now be described in conjunction with FIGS. 17–19.

With the bolt pin 234 in its leftwardmost position prior to operation of the gun (FIG. 17) the push plate 262 is also in its leftwardmost position in which an upper end portion thereof contacts the front limit switch 322 and de-energizes the motor 244. As illustrated, in this position of the push plate 262 its attached push block 263 is also spaced leftwardly of the bolt pin 234. At the opposite end of the charging assembly, the latch member 276 is pivoted to its clockwise limit position by the springs 293, and the outer end flange 320 of the extension rod 260 is in engagement with the body portions 314 of the release cams 310 so that their upper tab portions 316 hold the sear plate 294 in its rightmost position, against the biasing force of the spring 304, in which the front end 298 of the sear plate engages the stop surface 284 of the latch member 276 to prevent it from being rotated further in a clockwise direction.

When it is desired to arm the gun, the "safe" control 330 (FIG. 15) is actuated to cause the motor 244 to extend the rods 248, 260 and the push plate 262 rightwardly as indicated by the arrows 334 in FIG. 18. Initial rightward movement of the push plate 262 brings the push block 263 into contact with the bolt pin 234 and also moves the bolt pin rightwardly against the force of its associated internal return spring. As the push plate 262 approaches the latch member 276, the push block 263 and the bolt pin 234 are driven beneath the latch member 276 and an upper end portion of the push plate engages the outer end portion 280 of the latch member causing counterclockwise pivotal motion of the latch member about the pin 278 against the forces of the springs 293. Such rightward movement of the rod 260 moves its end flange 320 out of engagement with the release cam 310 to allow the spring 304 to drive the sear plate 294 leftwardly until its front end 298 is bought into locking engagement with the latch member stop surface 282 as depicted in FIG. 18.

At this point, the latch member outer end portion 280 has been pivoted into locking engagement with the bolt pin 234 and a lower end portion of the push plate 262 has come into engagement with the rear limit switch 326 to terminate rotation of the motor 244. This completes the rightward movement of the bolt pin 234 to its "safe" position at which a point a double safety lock is provided against leftward movement of the bolt pin toward its "armed" position caused by its associated return spring. The first portion of this double lock is provided by the outer end portion 280 of the latch member 276 which is prevented from rotating in a clockwise direction by the interengagement of the front end 298 of the sear plate and the stop surface 282 of the latch member. The second portion of the double lock is provided by the upper end of the push plate 262 which is held in firm engagement with the outer end 280 of the latch member by the stop motor 244.

When it is desired to move the bolt pin 234 leftwardly to its armed position within the slot 235, the "arm" control 332 (FIG. 15) is actuated to retract the rods 248 and 260, thereby moving the push plate 262 and the outer end flange 320 through their dotted line positions depicted in FIG. 18 as indicated by the dotted line arrows 336. During such leftward motion of the rods 248, 260, the bolt pin 234 is held in place in its "safe" position by the latch member 276 which is still precluded from clockwise bolt pin-releasing motion by the sear plate 294.

As the upper end of the push plate 262 approaches the front limit switch 322, the outer flange 320 on the extension rod 260 is brought into engagement with the bodies 314 of the release cams 310 and pivotally drives the cams about their pivot points 312 to cause the cam tabs 316 to drive the sear plate 294 rightwardly to its retracted position against the force of the spring 304. Such rightward movement of the sear plate 294 withdraws its front end 298 from engagement with the latch member stop surface 282 and permits the springs 293 to rightwardly pivot the latch member until its stop surface 284 is brought into locking engagement with the front end 298 of the sear plate.

This clockwise pivoting of the latch member 276 causes it to release the bolt pin 234 and permit its associated return spring to drive the bolt pin leftwardly toward its "armed" position as indicated by the arrow 338 in FIG. 19. At or just prior to this release of the latch member 276, the upper end of the push plate 262 has engaged the front limit switch 322 to again terminate the operation of the drive motor 244. At the point at which the push plate 262 has contacted the front limit switch 322, the push block 263 has been moved somewhat forwardly of the leftward limit position of the bolt pin 234 as depicted in FIG. 17. Positioning of the push block 263 and the latch member 76 as shown in FIG. 17 permits free front-to-rear reciprocation of the bolt pin 234 during subsequent firing of the gun.

In addition to the previously described advantages of the electrically driven charging assembly 240 of the present invention, it essentially eliminates the round-jamming problems typically associated with pneumatically operated chargers which drive the bolt pin between its armed and safe position. Specifically, by pneumatically driving the bolt pin to its armed position it has been found that the round being chambered is often caused to jam due to the relatively slow speed at which the bolt pin is being driven toward its armed position. As just described, however, in the present invention the bolt pin 234 is not driven by the charger assembly to its armed position. Instead, the push plate 262 is simply moved forwardly of the bolt pin 234 while the pin is still retained in its safe position by the latch member 276. At the end of the leftward travel of the push plate 262, the interaction between the rod flange 320 and the release cams 310 permits the pin 234 to be rapidly driven by its associated return spring to the armed position. It has been found that by this simple expedient of allowing the bolt pin's return spring to more rapidly return it to its armed position the round-jamming problem has been essentially eliminated.

The previously described operation of the electrically driven gun charging assembly 240, in addition to preparing the gun for initial firing in a uniquely safe manner, also provides another desirable safety feature arising after a firing period of the gun has occurred. Specifically, it is well known that particularly after a fairly long duration burst of machine gun fire, an unfired round in the chamber may be unintentionally caused to fire due to heat buildup in the gun immediately adjacent the chamber area. This, of course, can cause the gun to continue firing.

This potentially quite dangerous situation is also effectively eliminated by the charging assembly of the present invention. After a long duration firing burst has been terminated, the charging assembly can be simply operated to move the bolt pin to its "safe" position, in which it is double locked in such position, as previously described. This movement of the bolt pin to its safe position causes ejection of the last-chambered round to prevent it from overheating. It also functions to ventilate the gun barrel and chamber area to allow the chamber area to more rapidly cool down prior to the next desired firing operation. Additionally, the previously described double locking of the pin in its safe position permits the aircraft to be landed without a round in the chamber. The gun may then be more safely unloaded by the ground crew.

It can be seen from the foregoing that the present invention uniquely provides an electrically driven gun charging apparatus which is lighter in weight, safer in operation and considerably less prone to cause gun jamming than conventional pneumatically operated gun charging mechanisms.

Figure 20:
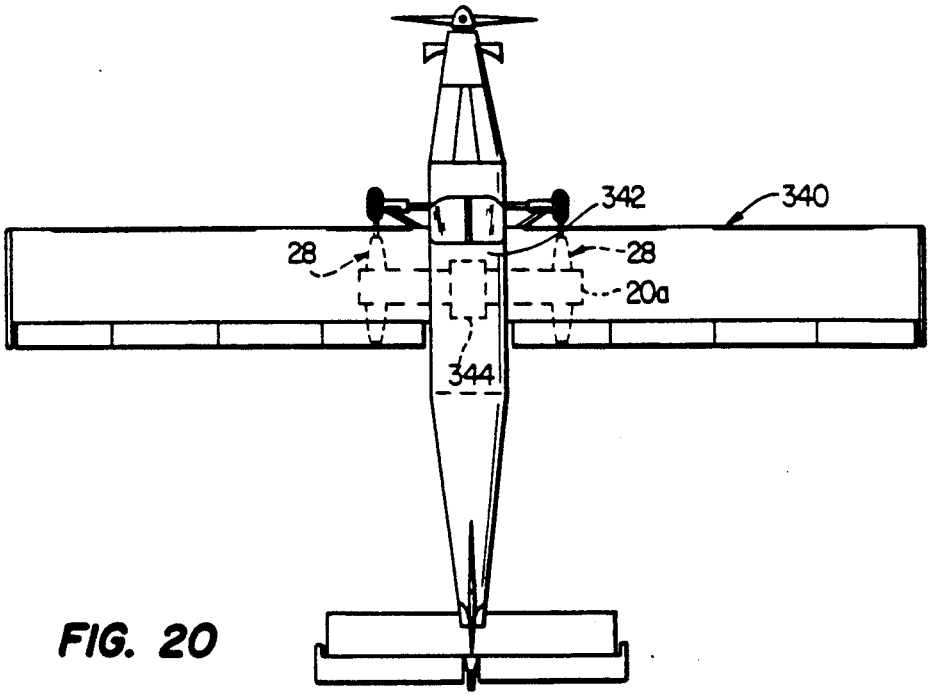
FIGS. 20, 21 and 22, respectively, are top plan, side elevational and front elevational views of a representative fixed wing aircraft to which a modified version of the armament mounting structure of the present invention is operatively connected.
Figure 21:
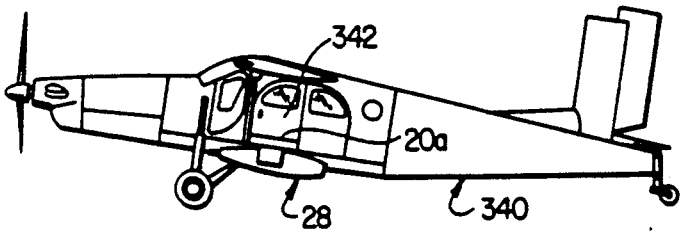
Figure 22:
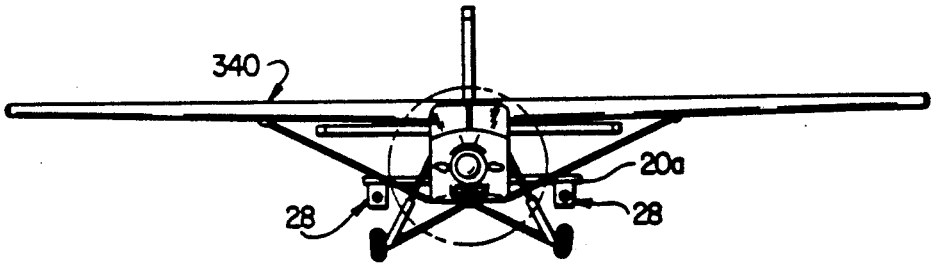

While the machine gun pod 28, which includes the gun mount 100, the gun 102, the charging assembly 240 and the outer fairing 232, is particularly well suited for mounting on a helicopter as previously described, it may also be mounted on a fixed wing aircraft such as the single engine airplane 340 depicted in FIGS. 20–22. For example, a pair of the pods 28 may be supported on a somewhat shorter plank member $20_a$ which is extended through the cabin area 342 of the plane and secured therein as previously described. The plank-mounted pods 28 may be fed from ammunition magazines 344 disposed in the cabin area atop the central portion of the plank $20_a$.

Figure 23:
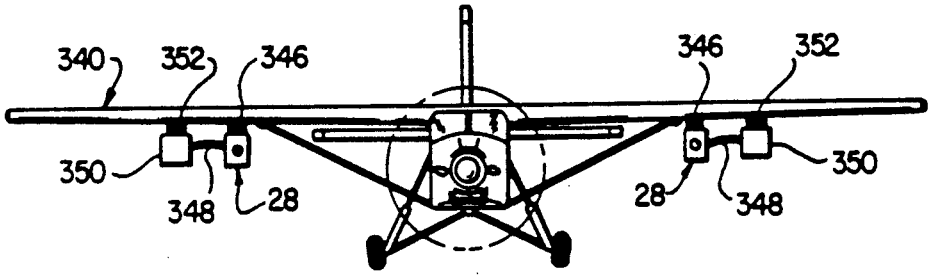
FIG. 23 is a view similar to that of FIG. 22 but illustrating the wing-mounting of a pair of machine guns, and associated external ammunition magazines, utilizing gun mounting assemblies of the present invention.

Alternatively, as depicted in FIG. 23, a pair of the pods 28 may be mounted on wing pylons 346 and supplied by ammunition belts 348 carried by external magazines 350 supported on wing pylons 352.

Although the recoil-absorbing gun mount 100 is particularly well suited to aircraft installations, it will be readily appreciated by those skilled in this art that it could also be utilized on other vehicles, or on stationary objects such as ground firing stations.

The foregoing detailed description is to be clearly understood as being given by way of illustration and example only, the spirit and scope of the present invention being limited solely by the appended claims.

What is claimed is:

1. Armament apparatus for an aircraft having a cabin area, comprising:

an elongated support plant member having a longitudinally central portion positioned between outer end portions of the plank member, each of said outer end portions of said plank member having an outer tip portion hingedly secured thereto and pivotable between an extended position in which the tip portion defines an outward extension of said outer end portion, and a retracted position in which the tip portion is pivoted upwardly and inwardly onto said outer end portion of the plank member;

means for securing said central portion of the plank member to the aircraft, within said cabin area thereof, in a manner such that said outer end portions of said support plank member project outwardly beyond opposite side portions of the aircraft;

a pair of support structures secured to and extending downwardly from said outer tip portions for supporting weaponry, each of said support structures being pivotable relative to the plank member about a first axis generally parallel to the longitudinal axis of said plank member;

means for operatively mounting said weaponry on said support structures;

means, associated with said support structures, for pivotally adjusting the mounted weaponry about vertical axes generally perpendicular to the support plank member;

means for selectively adjusting the pivotal orientations of said support structures, about said first axis, relative to the support plank member; and means positioned on said outer end portions of the support plank member inwardly of said outer tip portions, for operatively supporting a pair of machine guns below said plank member.

2. The armament apparatus of claim 1 further comprising:

a pair of machine guns and a pair of rocket launchers operatively mounted on the support plank member.

3. THe armament apparatus of claim 1 wherein:

the aircraft is a helicopter.

4. The armament apparatus of claim 1 wherein:

said apparatus further comprises a pair of external ammunition belt magazines disposed within said cabin area, and said outer end portions of said support plank have openings formed therein, inwardly of said machine gun supporting means, through which ammunition belts from said magazines may be routed to machine guns operatively supported on the plank member

5. The armament apparatus of claim 1 wherein:

said plank member is of a honeycombed metal construction.

6. The armament apparatus of claim 1 wherein:

the aircraft has a pair of upstanding mounting flanges disposed in said cabin area, and said means for securing said central portion of the plank member include a pair of connecting members secured to said central portion of the plank member, and means for anchoring said connecting members to said mounting flanges.

7. Armament apparatus for an aircraft having a cabin area, comprising:

an elongated support plank member having a longitudinally central portion positioned between opposite end portions of the plank member;

means for securing said central portion of the plank member to the aircraft, within the cabin area thereof, in a manner such that said opposite end portions of the plank member project outwardly beyond opposite sides of the aircraft; and means for operatively mounting weaponry to each of said outer end portions of the plank member projecting outwardly beyond opposite sides of the aircraft.

8. The armament apparatus of claim 7 wherein:

the aircraft is a helicopter.

9. The armament apparatus of claim 7 wherein:

the aircraft is a fixed wing aircraft.

10. The armament apparatus of claim 7 wherein:

said plank member is of a honeycomb metal construction.

11. Armament apparatus for an aircraft having a cabin area, comprising:

an elongated support plank member having a longitudinally central portion positioned between opposite end portions of the plank member;

means for securing said central portion of the plank member to the aircraft, within said cabin area thereof, in a manner such that said outer end portions of the plank member project outwardly beyond opposite sides of the aircraft; and means for operatively mounting weaponry on said outer end portions of the plank member, said means for operatively mounting weaponry on said outer end portions of said plank member comprising a pair of support structures secured to and extending downwardly from said outer end portions of said plank member, each of said support structures being pivotable relative to the plank member about a first axis generally parallel to the longitudinal axis of said plank member, and means for mounting said weaponry of said support structures.

12. The armament apparatus of claim 11 further comprising:

means, associated with said support structures, for pivotally adjusting the mounted weaponry about vertical axes generally perpendicular to the support plank member.

13. THe armament apparatus of claim 11 further comprising:

means for selectively adjusting the pivotal orientations of said support structures, about said first axis, relative to the support plank member.

14. Armament apparatus for an aircraft having a cabin area, comprising:

an elongated support plank member having a longitudinally central portion positioned between outer end portions of the plank member;

means for securing said central portion of the plank member to the aircraft, within said cabin area thereof, in a manner such that said outer end portions of the plank member project outwardly beyond opposite sides of the aircraft;

mounting means for operatively mounting weaponry on said outer end portions of the plank member; and a pair of machine guns operatively secured by said mounting means to said outer end portions of the plank member.

15. The armament apparatus of claim 14 further comprising:

a pair of machine guns and a pair of rocket launchers operatively mounted on the support plank member.

16. Armament apparatus for an aircraft having a cabin area, comprising:

an elongated support plank member having a longitudinally central portion positioned between opposite end portions of the plank member;

means for securing said central portion of the plank member to the aircraft, within said cabin area thereof, in a manner such that said outer end portions of the plank member project outwardly beyond opposite sides of the aircraft; and mounting means for operatively mounting machine guns on said outer end portions of the plank member, said apparatus further comprising a pair of machine gun ammunition belt magazines disposed within said cabin area, and said outer end portions of said support plank member having openings formed therein, inwardly of said mounting means, through which ammunition belts from said magazines are routed to machine guns operatively supported on the plank member by said mounting means.

17. Armament apparatus for an aircraft having a cabin area, the aircraft having a pair of upstanding mounting flanges disposed in said cabin area, said armament apparatus comprising:

an elongated support plank member having a longitudinally central portion positioned between opposite end portions of the plank member;

means for securing said central portion of the plank member to the aircraft within, said cabin area thereof, in a manner such that said outer end portions of the plank member project outwardly beyond opposite sides of the aircraft, said means for securing said central portion of the plank member including a pair of connecting members secured to said central portion, and means for anchoring said connecting members to said mounting flanges; and means for operatively mounting weaponry to said outer end portions of the plank member.

18. Armament apparatus for an aircraft having a cabin area, comprising:

an elongated support plank member having a longitudinally central portion positioned between outer end portions of the plank member;

means for securing said central portion of the plank member to the aircraft within said cabin area thereof in a manner such that said outer end portions of the plank member project outwardly beyond opposite sides of the aircraft; and means for operatively mounting weaponry on said outer end portions of the plank member, each of said outer end portions of said plank member including an outer tip portion which is pivotable between an extended position in which the tip portion defines an outward extension of said outer end portion, as a retracted position in which the outer tip portion is pivoted upwardly and inwardly onto said outer end portion of the plank member.

* * * * *